United States Patent [19]

Röhrig

[11] 4,375,830

[45] Mar. 8, 1983

[54] METHOD AND APPARATUS FOR SUPPORTING A STEEL STRAND PRODUCED DURING A CONTINUOUS STRAND CASTING METHOD

[75] Inventor: Adalbert Röhrig, Wädenswil, Switzerland

[73] Assignee: Concast AG, Zurich, Switzerland

[21] Appl. No.: 239,443

[22] Filed: Mar. 2, 1981

[30] Foreign Application Priority Data

Mar. 20, 1980 [CH] Switzerland ..... 2191/80

[51] Int. Cl.[3] ..... B22D 11/12

[52] U.S. Cl. ..... 164/468; 164/442; 164/504

[58] Field of Search ..... 164/504, 499, 468, 147.1, 164/442, 448

[56] References Cited

U.S. PATENT DOCUMENTS

| | | | |
|---|---|---|---|
| 2,947,075 | 8/1960 | Schneckenburger et al. | 164/460 |
| 3,952,791 | 4/1976 | Ito et al. | 164/468 |
| 3,987,841 | 10/1976 | Itoh et al. | 164/448 X |
| 4,244,419 | 1/1981 | Von Starck et al. | 164/504 |

FOREIGN PATENT DOCUMENTS

| | | | |
|---|---|---|---|
| 8376 | 3/1980 | European Pat. Off. . | |
| 2827240 | 1/1980 | Fed. Rep. of Germany | 164/504 |
| 51-19414 | 6/1976 | Japan | 164/468 |
| 53-42135 | 4/1978 | Japan | 164/468 |
| 53-16365 | 5/1978 | Japan | 164/504 |
| 2024679A | 1/1980 | United Kingdom | 164/504 |

*Primary Examiner*—Gus T. Hampilos
*Assistant Examiner*—J. Reed Batten, Jr.
*Attorney, Agent, or Firm*—Werner W. Kleeman

[57] ABSTRACT

In order to support a steel strand fabricated during a continuous strand casting method, and whose liquid core is agitated or stirred with the aid of an electromagnetic stirrer installed near the strand surface, the stirrer together with guide rolls is oscillatingly moved during the casting operation in the lengthwise direction of the cast strand.

3 Claims, 3 Drawing Figures

METHOD AND APPARATUS FOR SUPPORTING A STEEL STRAND PRODUCED DURING A CONTINUOUS STRAND CASTING METHOD

BACKGROUND OF THE INVENTION

The present invention relates to a new and improved method of, and apparatus for, supporting a continuously cast strand, especially a steel strand, fabricated during a continuous casting method for strands, wherein the liquid core of the casting or strand is stirred by electromagnetic action.

It is known in the strand casting art to support and guide by means of support guide elements, for instance rolls, a steel strand emanating out of the continuous casting mold until there has been accomplished complete solidification of the strand. In most instances the strand is transferred from along an arcuate-shaped guide path into a horizontal path. Depending upon the size of the strand format or sectional shape which is to be cast there are required along such guide path different numbers of successive guide rolls, so as to prevent any bowing-out of the strand shell or skin due to the ferrostatic pressure of the liquid core.

Furthermore, it is known in the art to obtain by electromagnetic stirring of the melt in the liquid core of the strand an improvement in the quality of the cast product. The solidification structure should be affected in such a manner that there is produced as large as possible zone of compact or dense, equiaxed crystal structure with uniform distribution of the elements tending towards segregation over the strand cross-section. For physical reasons it is attempted to place the electromagnetic stirrer as closely as possible to the strand surface, so that there can be obtained a sufficiently great penetration depth of the traveling electromagnetic field with the smallest possible electrical losses.

Because of the required small spacing between successive guide rolls when casting large strand sectional shapes or formats and the thus small amount of available space, it is only possible to obtain the desired small spacing of the stirrer from the strand surface when resorting to structural aids which, in turn, are associated with appreciable drawbacks. With a state-of-the-art arrangement of the electromagnetic stirrer there is generated an induction stirring field for the molten core or pool of the casting at the direct neighbourhood of one longitudinal side of the cast slab. Directly above and below the stirrer there is accomplished supporting of the strand shell by smaller guide rolls connected with the stirrer, in order to maintain as small as possible the spacing between successive guide rolls at the region of the stirrer. However, this arrangement is afflicted with the drawback that for the build-up of an induction field which is effective at the slab there must be used a relatively large stirrer which has a not inappreciable width in the slab lengthwise direction. Consequently, the spacing between the guide rolls automatically becomes greater than the standard spacing. At the direct effective region of the stirrer it is however not possible to support the strand, so that there can arise undesired, damaging bowing-out of the strand skin or shell.

Furthermore, the liquid pool or core of the casting is only moved directly at the effective region of the stationary stirrer, so that due to the limited stirrer size there is also limited the quantity of the agitated or stirred steel.

SUMMARY OF THE INVENTION

Therefore, with the foregoing in mind it is a primary object of the present invention to provide a new and improved method of, and apparatus for, supporting a continuously cast strand produced during a continuous casting operation, in a manner not associated with the aforementioned drawbacks and limitations of the prior art proposals.

Another and more specific object of the invention aims at preventing damaging bow-out of the strand shell of an unsupported strand portion or section located momentarily at the region of action of the electromagnetic stirrer.

A further significant object of the present invention is to provide a new and improved method and apparatus for supporting a continuously cast strand, specially a steel strand, whose liquid or molten pool is agitated by the action of a stirrer, in a manner such that there is effectively prevented or at least minimized the danger of the undesired bowing-out of the strand shell or skin.

Now in order to implement these and still further objects of the invention, which will become more readily apparent as the description proceeds, the method for supporting a continuously cast strand, specially a steel strand, produced by continuous casting, wherein its liquid core is electromagnetically stirred, is manifested by the features that guide rolls together with the electromagnetic stirrer effective between the guide rolls are oscillatingly moved during the continuous casting operation in the lengthwise direction of the cast strand.

Due to the oscillation of the guide rolls there is achieved the beneficial result that the time interval during which the relevant strand section below the stirrer is unsupported can be reduced to a degree which is not damaging in terms of undesired strand bow-out. Bowing-out of the strand shell can be extensively prevented and incipient, smaller bowed-out portions of the strand can be again forced back due to the to-and-fro movement of the rolls or rollers. Additionally, by virtue of the oscillation the good heat withdrawal out of the strand which is present in any event is intensified by means of the rolls, so that there is increased the growth of the strand shell.

By virtue of the fact that the electromagnetic stirrer likewise co-oscillates its magnetic field additionally influences, viewed in the strand lengthwise direction, an appreciably longer region of the molten pool or liquid core, so that also when working with a small dimensioned stirrer there can be stirred a relatively larger strand section. Furthermore, the molten metal is forced to move in a helical-shaped flow due to the oscillatory motion, something which has a positive effect upon the agitation of the liquid core which affects the solidification of the strand.

As already mentioned above the invention is not only concerned with the aforementioned method aspects, but deals with apparatus for the performance thereof, wherein the inventive apparatus contemplates that the electromagnetic stirrer is provided with an oscillation device or means.

According to a further feature of the invention the stirrer is provided with support rolls, so that there can be avoided a bending-through of the rolls. In this way it is possible to use appreciably smaller rolls, so that the space requirements needed for the oscillatory movement above and below the stirrer can be appreciably reduced, and thus there also can be shortened the portion or section of the strand which is unsupported. The same effect can be however also obtained with subdivided guide rolls, in which case then there can be dispensed with the use of support rolls.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
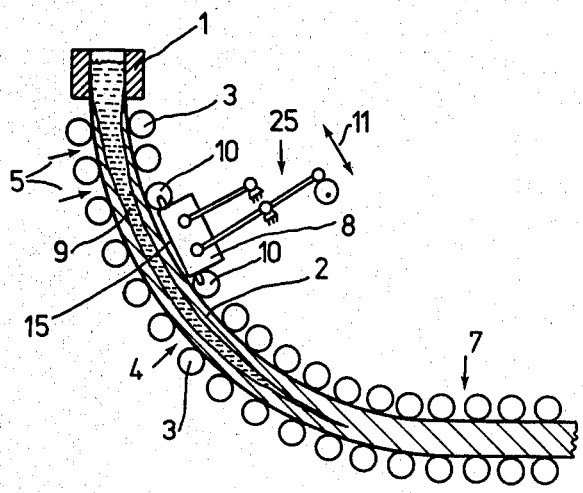
FIG. 1 is a schematic side view of a continuous casting installation for strands equipped with equipment of the present invention.

Describing now the drawings, it is to be understood that only enough of the continuous casting installation has been shown to enable those skilled in the art to readily understand the underlined principles and concepts of the development of the present invention. Turning attention now specifically to FIG. 1, reference numeral 1 designates a water-cooled, oscillating, curved or arc-type throughpass or open-ended mold for casting slabs. Liquid steel is introduced from a not particularly shown but standard casting vessel, such as a tundish, by means of a pouring tube into the continuous casting mold 1 in a manner well known in this technology. The steel superficially solidifies in the continuous casting mold 1 and forms a strand shell or skin which continuously grows in the casting direction. The solidified strand shell of the cast strand is supported and guided by the subsequently arranged guide rolls 3 of a curved strand path or strand guide arrangement 4, also referred to as a roller apron. By means of spray nozzles 5 mounted between the guide rolls 3 a suitable coolant or cooling agent, typically water, is sprayed onto the strand surface for the further cooling of the strand tube. By means of a conventional withdrawal and straightening machine, generally schematically represented by reference character 7, the strand 2 is withdrawn and straightened.

Figure 2:
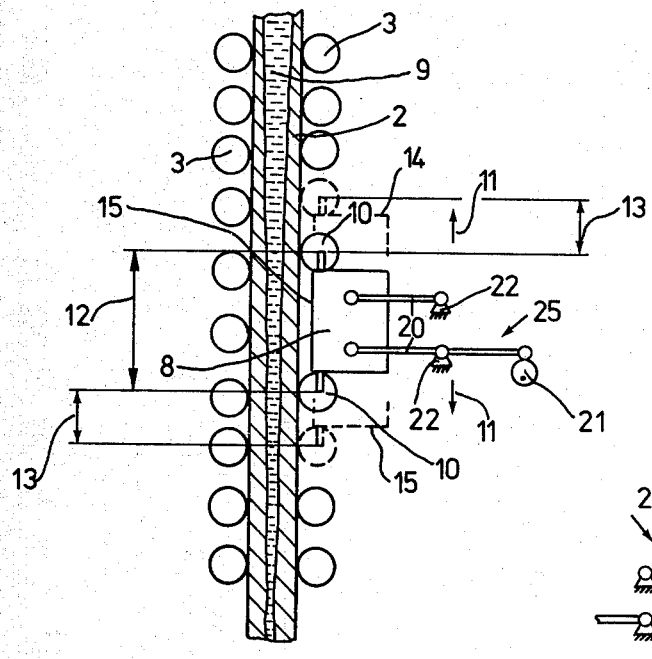
FIG. 2 illustrates the equipment or apparatus of FIG. 1 in enlarged side view.

Now in FIG. 2 there is shown in a section from the illustration of FIG. 1 the electromagnetic stirrer 8 wherein, here, to simplify the illustration the strand 2 has been shown guided in a linear path of travel. At a spacing of about 5 meters below the outlet end of the mold 1 there is installed at the curved inner side of the strand guide arrangement or path 4, at a small spacing from the strand surface, the electromagnetic stirrer 8 which, as is likewise well known in the continuous casting art, contains travelling field magnets for producing electromagnetic travelling fields for stirring the strand pool or liquid core 9. Viewed in the casting direction there is arranged at the upper and lower stirrer side a respective guide roll 10, preferably formed of non-magnetizable steel. By means of an oscillation device or oscillation means 25 it is possible to move the stirrer 8, as generally indicated by the double-headed arrow 11, to-and-fro along the strand path or strand support arrangement 4, and such stirrer 8 which is oscillated in this fashion alternately is moved into the upper position 14 and the lower position 15 shown in phantom lines.

The oscillation means or device 25, in the exemplary embodiment under discussion, can comprise a lever system 20 equipped with an eccentric 21, and the levers 20 are supported by means of fixed supports or fulcrums 22 or equivalent structure.

However, it is equally possible to move the stirrer 8 to-and-fro by means of a reversible drive motor along guide rails arranged concentrically with respect to the strand path or strand guide arrangement.

The slabs cast upon the described continuous casting installation had a sectional shape or format of 300 by 1800 mm, the withdrawal speed amounted to about 1.0 m/min, the guide roll diameter amounted to about 250 mm. Viewed in the casting direction the electromagnetic stirrer had a length of 800 mm, so that a spacing 12 of approximately 1100 mm existed between the guide rolls 10 mounted at the stirrer 8. The oscillation stroke of the stirrer 8 amounted to about one-half of the stirrer width or approximately one-half of a roll revolution, so that above and below the stirrer 8 there was present an unsupported strand section or portion 13 of about 400 mm. In order to uniformly cool these rolls or rollers 10, in certain instances it can be advantageous if they once perform during the oscillation a full revolution, so that in such instances the unsupported strand sections 13 increase. Due to the still slight thickness of the strand shell at the region of the stirrer 8 and the ferrostatic pressure of the molten metal pool or core 9 the strand 2 has the tendency to bow-out, particularly at the strand regions 12 and 13. Therefore the stirrer 8 together with the rolls 10 must be moved to-and-fro with such a speed that the time interval, during which the strand shell is unsupported at the regions 12 and 13, can be maintained as short as possible. The oscillation speed of the stirrer 8 therefore, depending upon the roll diameter and the desired cooling, should amount to a multiple of the strand withdrawal speed; in the present example such amounted to about 50 cm/sec. The effective surface 15 at the stirrer 8 was configured to be convex, concentric to the guide path, so that it had at each point of its path of travel the same spacing from the strand surface, so that there could be avoided additional electromagnetic losses. Of course, the electromagnetic stirrer 8 at the related rolls 10 also can be mounted at the outer curved side of the roller apron or strand guide arrangement, so that the side of the stirrer confronting the strand possesses a corresponding concave curvature. When using the inventive equipment in a continuous casting installation for strands with linear strand guiding, of course, the effective or operative surface 15 of the stirrer 8 likewise must be designed to be straight or linear.

Additionally, the stirrer upper and lower edges neighbouring the strand can be bevelled in order to obtain a smaller spacing 12 of the rolls 10. Equally, it is possible, as shown in FIG. 3, to use small rolls 23 provided with additional support rolls 24 mounted at the stirrer and preventing any bending-through.

With a roll diameter of the guide rolls 23 of, for instance, only 100 mm and an oscillation stroke in the order of magnitude of one-half of the stirrer width these rolls 23 perform a complete revolution, so that there is obtained good cooling of the rolls and there can be avoided thermal distortion.

Figure 3:
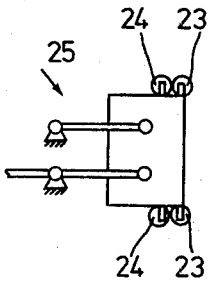
FIG. 3 shows an arrangement employing the stirrer depicted in FIG. 2 utilizing support rolls for the guide rolls.

Of course, the guide rolls 23 and support rolls 24 can have a different size relationship than shown in FIG. 3.

Equally, it is possible for the rolls 23 and the rolls 24 to be subdivided into a number of individually mounted roll sections.

The stirrer can of course be equipped with spray nozzles which are effective from its stirrer side 15 confronting the strand 2 and which co-oscillate, so that there can be realized an advantageous cooling of the strand at the stirrer operative or effective regions 12 and 13.

While there are shown and described present preferred embodiments of the invention, it is to be distinctly understood that the invention is not limited thereto, but may be otherwise variously embodied and practiced within the scope of the following claims. Accordingly,

What I claim is:

1. A method of supporting a continuous cast strand, specially a steel strand, produced during a continuous casting operation, wherein the liquid core of the cast strand is electromagnetically stirred, comprising the steps of:

providing guide rolls and an electromagnetic stirrer cooperatively arranged between said guide rolls; and during the continuous casting operation oscillating the guide rolls together with the electromagnetic stirrer arranged therebetween in the lengthwise direction of the cast strand.

2. An apparatus for supporting a continuously cast strand at a continuous casting installation, specially for the continuous casting of steel, comprising:

a continuous casting mold in which there is cast the steel into a strand;

a strand guide means arranged following the continuous casting mold;

an electromagnetic stirrer for stirring a liquid core of the continuously cast strand;

guide rolls attached to said electromagnetic stirrer; and oscillation means associated with said electromagnetic stirrer.

3. The apparatus as defined in claim 2, further including:

support rolls provided for said electromagnetic stirrer and coacting with said guide rolls.

* * * * *